US006974039B2

(12) United States Patent
Comartin et al.

(10) Patent No.: US 6,974,039 B2
(45) Date of Patent: Dec. 13, 2005

(54) MULTI-MEMBER SUPPORT STORAGE IMPLEMENT FOR PLATE-LIKE WEIGHTS

(76) Inventors: Chad Gordon Comartin, 1711 Kildare Road, Windsor, Ontario (CA) N8W 2W5; Mark Kurt Vockentanz, 972 Thistledown Way, London, Ontario (CA) N6G 4Z6

( * ) Notice: Subject to any disclaimer, the term of this patent is extended or adjusted under 35 U.S.C. 154(b) by 0 days.

(21) Appl. No.: 10/346,751

(22) Filed: Jan. 17, 2003

(65) Prior Publication Data

US 2004/0140277 A1 Jul. 22, 2004

(51) Int. Cl.[7] ..... A63B 26/00
(52) U.S. Cl. ..... 211/41.1; 482/92
(58) Field of Search ..... 211/59.1, 49.1, 211/85.7, 60.1, 41.1, 41.2, 41.12, 23, 24; D6/552; D21/690, 691, 686; 482/104, 106, 482/92

(56) References Cited

U.S. PATENT DOCUMENTS

| | | | | | |
|---|---|---|---|---|---|
| 293,783 | A | * | 2/1884 | Ransom | 211/23 |
| 878,315 | A | * | 2/1908 | Samso | 211/41.3 |
| 2,504,947 | A | * | 4/1950 | Grange | 269/296 |
| 2,670,853 | A | * | 3/1954 | Schneider | 211/49.1 |
| D213,629 | S | * | 3/1969 | Roper et al. | D6/552 |
| 3,557,966 | A | * | 1/1971 | Skubic | 211/24 |
| D235,619 | S | * | 7/1975 | Ziaylek, Jr. | D8/373 |
| D238,735 | S | * | 2/1976 | Trieschmann | D6/552 |
| D245,053 | S | * | 7/1977 | Domansky | D6/552 |
| 4,084,700 | A | * | 4/1978 | Dunchock | 211/41.1 |
| D257,193 | S | * | 10/1980 | Glage | D6/552 |
| 4,253,575 | A | * | 3/1981 | Van Winkle | 211/85.7 |
| D268,309 | S | * | 3/1983 | Wall | D6/552 |
| D276,961 | S | * | 1/1985 | Kemper | D6/466 |
| D307,367 | S | * | 4/1990 | Provins | D6/552 |
| 5,145,074 | A | * | 9/1992 | Miley | 211/41.2 |
| 5,163,567 | A | * | 11/1992 | Betts, Sr. | 211/59.1 |
| D356,907 | S | * | 4/1995 | Jernigan | D6/463 |
| 5,673,800 | A | * | 10/1997 | Connolly | 211/41.7 |
| 6,145,674 | A | * | 11/2000 | Spearman et al. | 211/59.1 |
| 6,406,409 | B1 | * | 6/2002 | Silver | 482/104 |
| D468,946 | S | * | 1/2003 | Harms et al. | D6/552 |
| 6,622,875 | B2 | * | 9/2003 | Humphrey | 211/59.1 |

OTHER PUBLICATIONS

Two(2) web pages from "www.Fitness Destination.com" showing "weight trees". Copyright 2000.*

* cited by examiner

*Primary Examiner*—Blair M. Johnson

(57) ABSTRACT

A implement for storing weight lifting plates whereby the plates cannot be placed incorrectly. The invention comprises plural foundation members adapted to create a base of support or to attach the implement to existing structures. Mainframe members connect upwardly therefrom to form the structure of the implement. Each plate station is comprised of two horizontal-extender members mounted perpendicular to the mainframe member at a predetermined height and protruding laterally by various distances. Attached to the outermost end of each horizontal-extender member is a forwardly protruding plate-support member, adapted to support the plates with maximal surface contact. A height-limiting member is centrally mounted to the mainframe member and protruding forwardly, superior to the plate-support members at a predetermined distance depending on the plate size. Mounted flush to the mainframe member, between the plate-support and height-limiting members, is a false plate adapted to render the plate location obvious when the station is empty.

7 Claims, 5 Drawing Sheets

MULTI-MEMBER SUPPORT STORAGE IMPLEMENT FOR PLATE-LIKE WEIGHTS

BACKGROUND OF THE INVENTION

1. Field of the Invention

The present invention relates generally to the field of weight lifting, and in particular to the storing and handling of plate-like weights. More specifically, the invention provides an exemplary, progressive weight storage implement.

2. Discussion of the Prior Art

Free weights have been used for decades as an excellent means by which individuals can increase their muscular strength and improve overall physical conditioning. Free weights consist primarily of dumbbells, barbells, and other devices that can be freely moved and manipulated around the fitness center or gym. Often, this medium of exercise requires the individual to place one, or a plurality of weight lifting plates or discs of various sizes onto a particular exercise machine or device to achieve the desired resistance. Such plates typically comprise a circular or multi-sided, solid steel object of varying weight. The weight, and accordingly, the overall plate dimensions correspond to one of several standard plate sizes. Once the individual concludes the exercise, the weight plates need to be returned to a storage or holding implement, such as a rack, which may be a free standing device or attached to existing exercise machines. These storage implements are typically called "weight trees" or "weight horns." These implements are dispersed throughout the fitness center to provide individuals a place to retrieve and return the plates before and after completing free weight exercises.

The traditional design of these weight storage implements utilize a 1-inch (Standard) or a 2-inch (Olympic) center opening that exist on all weight lifting plates, adapted to receive a bar end or support post. The 1-inch design is used primarily for home fitness products, whereas the 2-inch center opening is used almost exclusively in commercial fitness settings. These implements use single, outwardly projecting cylindrical or square shaped support posts that are small enough to pass through the center opening of the plates as a means for supporting the weight. The weights are stored by simply placing the center opening of the plate over the single support post and allowing the plate to come to rest on the support post or its connected frame. These support posts can be of varying lengths and are designed to allow multiple plates to be placed on any one given post, thus making efficient use of the storage space.

The weight plates previously mentioned come in seven typical sizes or weights. All fitness equipment manufacturers most commonly produce plates in these weights: 100 pounds (45.3 Kg), 45 pounds (20.4 Kg), 35 pounds (15.9 Kg), 25 pounds (11.3 Kg), 10 pounds (4.6 Kg), 5 pounds (2.2 Kg) and 2.5 pounds (1.1 Kg). In order to allow these plates to work universally with all plate-loaded equipment, an industry standard of 1 or 2-inch center openings exist on all plates, regardless of size/weight. These standards are beneficial for the use of free weight equipment, but present problems for the storage of these weights. Since all weight storage implements use support posts small enough to pass through the standard center openings, and the center openings are identical on all plates, a 5-pound plate can be placed on the same storage post as a 45-pound plate. This leads to disorganized weight storage throughout the fitness center. To avoid this scenario, equipment manufactures and health club personnel often place labels on or near the support posts to indicate the proper plate size that is to be placed there. Unfortunately, due to error or just laziness, individuals continue to place these weights on spots designated for other size plates. This causes frustration for individuals wishing to have access to plates that become buried behind misplaced plates. Health clubs and fitness facilities are constantly expending man-hours reorganizing these weight storage implements to keep the facility neat looking and the plates easily accessible to all members. Convenience and neatness are critical to the success of any fitness center. Furthermore, because some of these plates are quite heavy, the reorganization by staff or club members leads to greater chance of injury due to excessive and unnecessary lifting.

The traditional single-support design is known within the prior art. Spearman et al, in their U.S. Pat. No. 6,145,674 for a Support Device for Plate-like Weights, illustrate this very design. While this device does meet their respective objectives and requirements for minimizing storage space, it does not attempt to resolve the problems inherent to the single-support post design.

In an attempt to address the shortcomings mentioned above, at least one manufacturer, namely, Iron Grip Barbell Company Inc, of Costa Mesa, Calif. has patented a monitoring system for weight lifting implements, including weight plates (U.S. Pat. No. 6,014,078). This system uses electrical transmitters and receivers that are mounted to weight lifting implements and storage devices respectively. Once a transmitter is attached to a weight lifting implement, it is given a unique identification signal that is stored in the memory of the respective receiver attached to the storage device. In the event that a weight lifting implement is placed in an improper location, the monitoring system processor notices the mismatch in signal transmission and generates an audio or visual error signal. This signal continues until the implement is placed in the correct location. Such a system does have its drawbacks. The expense required to implement such a system would be large due to a great deal of electrical equipment that would need to be purchased since each free weight implement and storage station would require either a transmitter or receiver. The requirement of electrical current needed to run this system poses a problem since many storage implements are place in the middle of the fitness center floor where electrical outlets would not be immediately available. In this case, battery power would be necessary and the cost to replace those on a continual basis would be significant. Additionally, due to the sophisticated equipment utilized in its operation, initial set-up and routine maintenance of such a system would require specialized knowledge not readily available. Furthermore, this system does not prevent the misplacing of weight lifting implements, but only serves to warn when something has been misplaced. Since this system would be applied to the existing plate storage devices (trees, horns) that utilize the single support bar design, the opportunity to misplace the weight plates still exists.

Accordingly, it is apparent that there is a need in the art for a weight storage device that does not require the purchase and maintenance of sophisticated equipment and, at the same time, prevents the misplacing of weight plates entirely. This device would need to be of simple construction and fabricated out of readily available materials. The design would have to stray from the typical single support post design and utilize an aspect of the weight plates that is not consistent across all sizes, thus allowing each support station to be tailored to each plate size respectively. The present invention meets these requirements. Further objects and advantages of our invention will become apparent from consideration of the drawings and ensuing description.

BRIEF SUMMARY OF THE INVENTION

In light of the aforementioned disadvantages apparent in the prior art, the present invention addresses and alleviates these deficiencies related to the storage of plate-like weights. In this regard, the present invention is directed to a plate storage station that completely prevents all typical weight plates from being placed within the incorrect station. This design can be used in a multitude of configurations whether on weight trees or as independent stations attached to existing exercise apparatus.

Briefly, and in general terms, the present invention generally comprises a plurality of foundation-support bars spanned and separated by one or a plurality of foundation-mainframe bars, creating a stable base for the implement. One or several mainframe bars are erected upwardly therefrom and preferably angled back from the vertical plane. In the case of an independent station design, the mainframe bar can be adapted to attach directly to existing weight lifting implements, without the need for foundation support. Each weight plate station is comprised of two horizontal-extender bars mounted perpendicular to the mainframe bar and parallel with the horizontal plane at a predetermined height and protruding laterally by varying distances for each plate size. Attached to the outermost end of each horizontal-extender bar is a forwardly protruding plate-support bar adapted and oriented to support the plate with maximal surface contact. Two laterally opposite plate-support bars are adapted as such, in conjunction, to suspend a weight plate. A height-limiting bar is centrally mounted directly to the mainframe bar and protruding forwardly and superior to the plate-support bars at a predetermined distance depending on the plate size. The combination of the above mentioned mainframe bar, horizontal-extender bars, plate-support bars, and height-limiting bar create a weight plate station. Within the weight plate station, mounted flush to the mainframe bar, superior to the plate-support bars and inferior to the height-limiting bar, is a false plate, constructed of any soft, durable, light weight material. Inclusion of this false plate aids in rendering the plate location obvious when the station is empty.

BRIEF DESCRIPTION OF THE SEVERAL VIEWS OF THE DRAWING

The present invention, with both its organization and method of operation, together with further objects and advantages, will become apparent upon consideration of the following detailed description of specific embodiments thereof, especially when taken in conjunction with the accompanying drawings in which.

The detailed description hereafter, including the appended drawings, is intended as a description of the presently illustrative embodiments of the invention and is not intended to represent the only form in which the present invention may be constructed or utilized. This description outlines the sequence of steps for constructing and operating the invention. It is understood that the same, or equivalent functions, or sequences may be accomplished by different embodiments and that each variation is intended to be encompassed within the scope of this invention. For example, the weight plate stations could be constructed to manually adjust to fit any of the standard plate sizes, allowing for the tailoring of the storage implement to the needs of the fitness center.

DETAILED DESCRIPTION OF THE INVENTION

Figure 1:
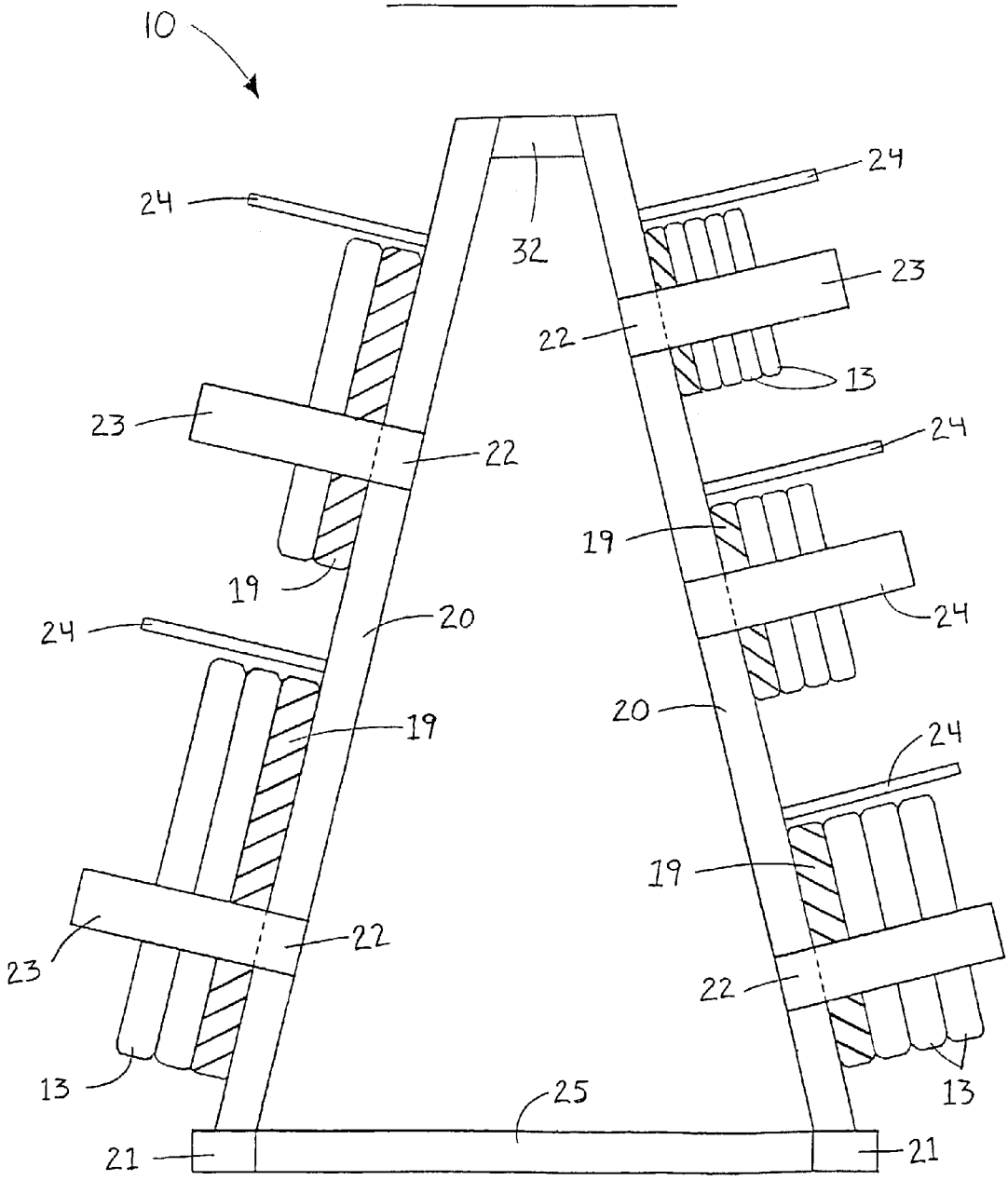
FIG. 1 is a side elevation view of the present invention embodied in a 5-station plate tree.
Figure 2:
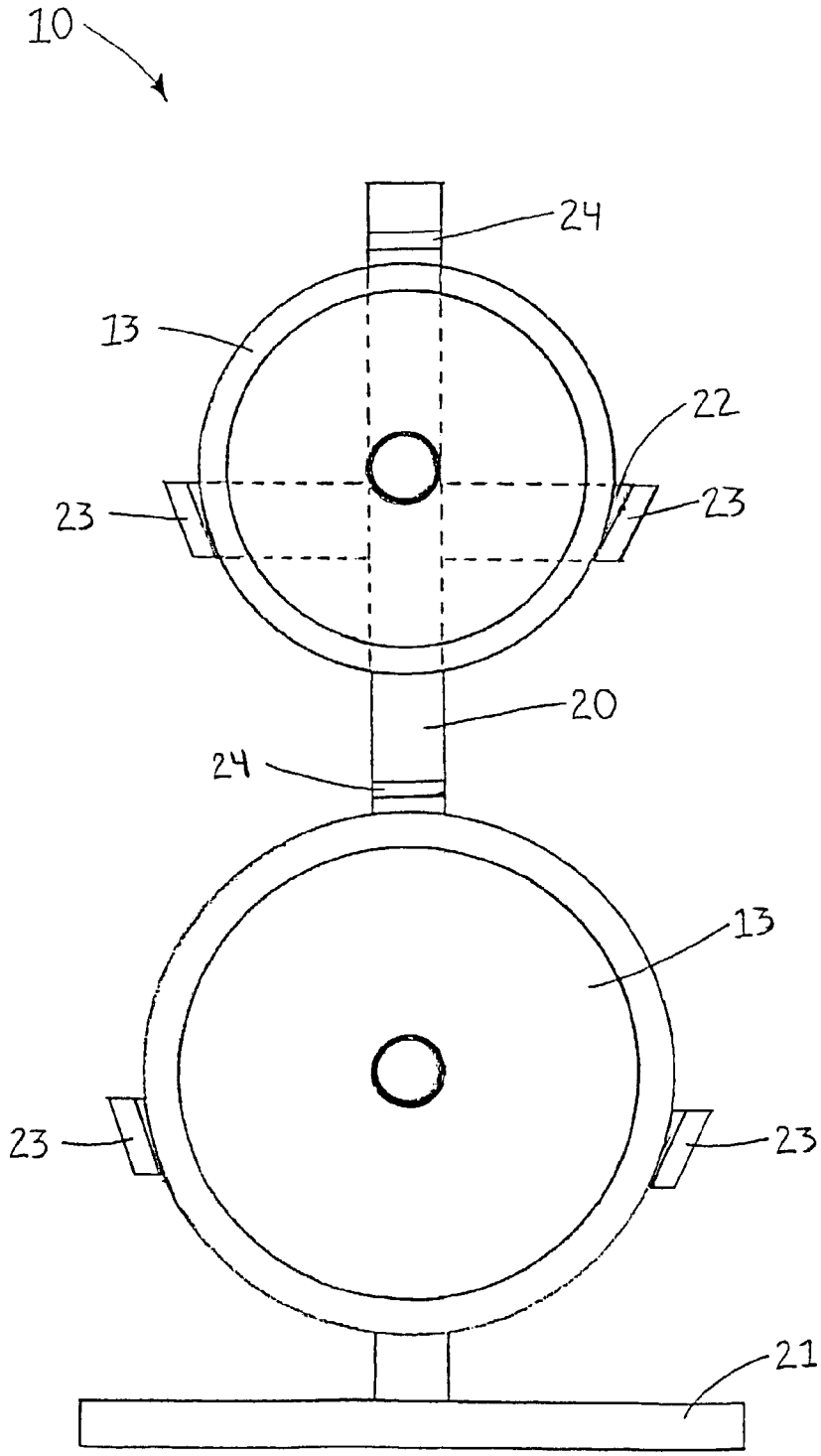
FIG. 2 is forward elevation view of the present invention embodied in a 2-station side of a plate tree, similar to the tree shown in FIG. 1 and having weight plates placed on both plate stations.
Figure 3:
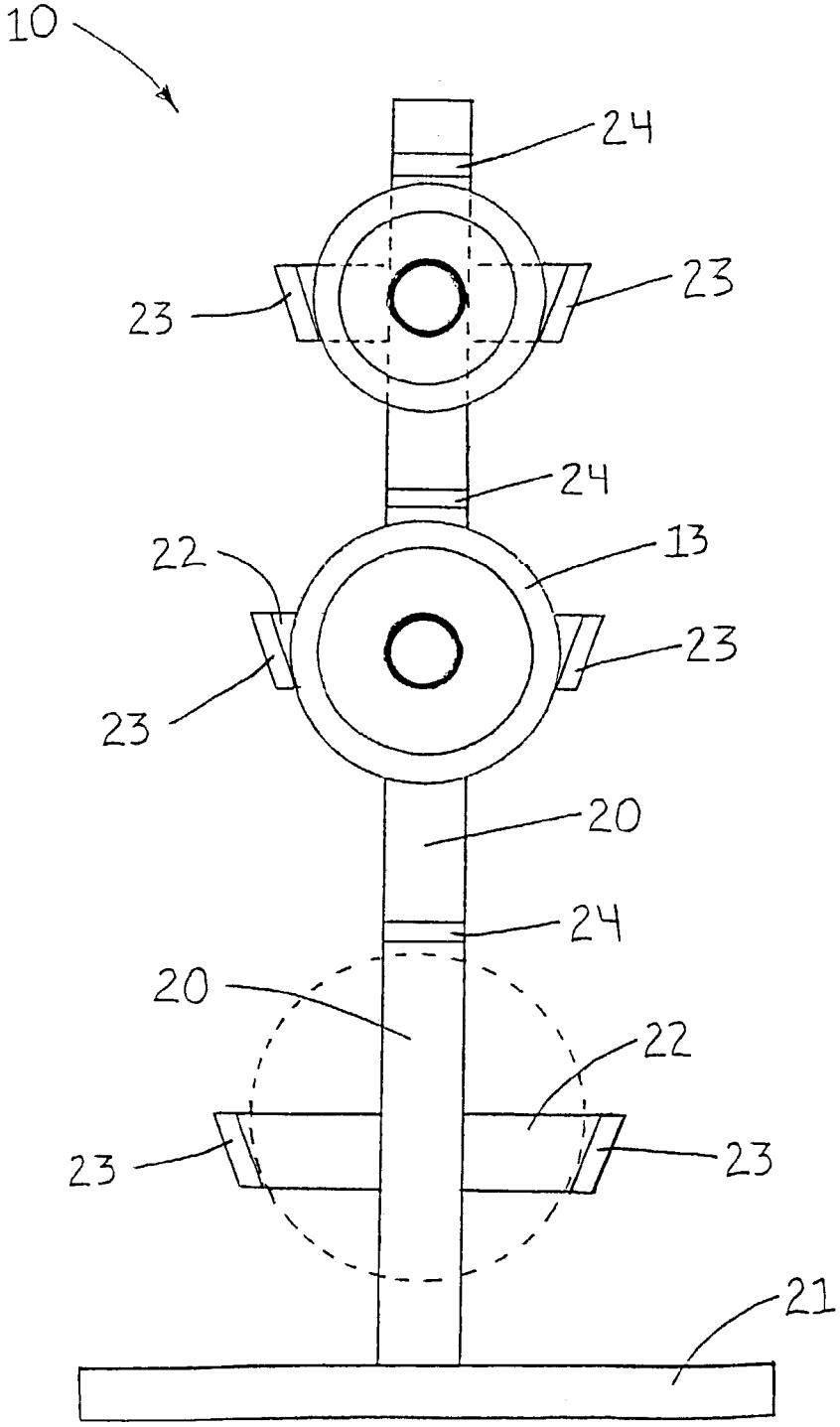
FIG. 3 is another forward elevation view of the present invention embodied in a 3-station side of a plate tree similar to the tree shown in FIG. 1 and FIG. 2 and having weight plates placed in the top two plate stations.

Referring now to the drawings, and in particular FIGS. 1, 2 and 3, one illustrative embodiment of a multi-member support storage implement in a plate tree configuration is generally identified by the reference numeral 10. Plate tree 10 is ideally fabricated from round, or multi-sided steel tubing, similar to most fitness equipment manufactured today and adapted to support a plurality of weight plates 13. A foundation-mainframe bar 25 is mounted horizontally centered and perpendicular between two foundation-support bars 21 to form a generally H-shaped ground base for the plate tree 10. The dimensions of the foundation-support bars 21 and foundation-mainframe bar 25 are sufficiently sized to provide a stable base to support a large amount of weight and to prevent any chance of the tree toppling over when the weight plates 13 are dispersed unevenly. Centrally mounted from each foundation-support bars 21, extending diagonally upward therefrom, and large enough to accommodate a plurality of plate stations, is a mainframe bar 20. Each mainframe bar 20 is angled inwardly from the vertical plane to prevent the weight plates from falling from the plate stations. The mainframe bars 20 connect to each other at their upper-most ends via an apex-connect bar 32, thereby forming an A-shaped vertical structure.

Referring still to FIGS. 1, 2 and 3, protruding laterally from both sides of the mainframe bar 20, for every plate station, are two horizontal-extender bars 22. The length of the horizontal-extender bars 22 varies for each plate station and is determined by the diameter of the particular weight plate to be placed within the station. Mounted forwardly and perpendicular from the outer-most end of each horizontal-extender bar 22 are plate-support bars 23. The plate-support bars 23 are greater than 2 inches in width so as to not allow the universal center openings of any weight plate to be placed upon them and would be preferably fabricated out of a non-marking metal such as chrome or stainless steel. Ideally, the plate-support bars 23 are oriented to allow for maximum surface contact between them and the plates and will ideally protrude 8 inches forward from the horizontal-extender bars 22, hereby allowing for an adequate number of plates to be stored in each station. The linear distance between the inner-most surfaces of the plate-support bars 23 should be substantially equal to ninety-two percent of the diameter of the average plate for each given plate size to ensure that only the specific plate size meant to be stored thereupon can occur. This span will allow the plate 13 to be sufficiently supported between the plate-support bars 23 and prevent any plate of a smaller size to be placed within the station. The horizontal-extender bars 22 and the plate-support bars 23, in conjunction, are formed to create a cradle for which the plate will be supported.

In further reference to FIGS. 1, 2 and 3, at each plate station, mounted directly to the mainframe bar 20, and superior to the plate-support bars 23, is a forwardly protruding height-limiting bar 24. The height-limiting bar 24 would be of the same size and structure as the plate-support bars 23 to prevent plates from being placed around it and to accommodate a sufficient number of plates at each station. The distance between the height-limiting bar 24 and the corresponding plate-support bars 23 for each station will vary according to the size of plate that is to be stored therein. To ensure a larger plate cannot be placed in any given station, the distance between the upper-most portion surface of the plate-support bars 23 and the lower-most surface of the height-limiting bar 24 should be substantially equal to seventy-seven percent of the diameter of the plate to be stored therein.

Located within each plate station, mounted directly to the mainframe bar 20, superior to the plate support bars 23 and inferior to the height-limiting bar 24 is a false plate 19. This false plate 19 would ideally be constructed out of a soft, durable, non-marking material such as rubber, and have the same dimensions of the standard weight plates for each station. The false plate 19 would have large markings on the planar surface indicating the size of the plate to be placed within the station. This false plate 19 would serve to render the plate location obvious when the plate station is empty and to protect the mainframe bar 20 and horizontal-extender bars 22 from being scratched when contacted by the plates.

Figure 4:
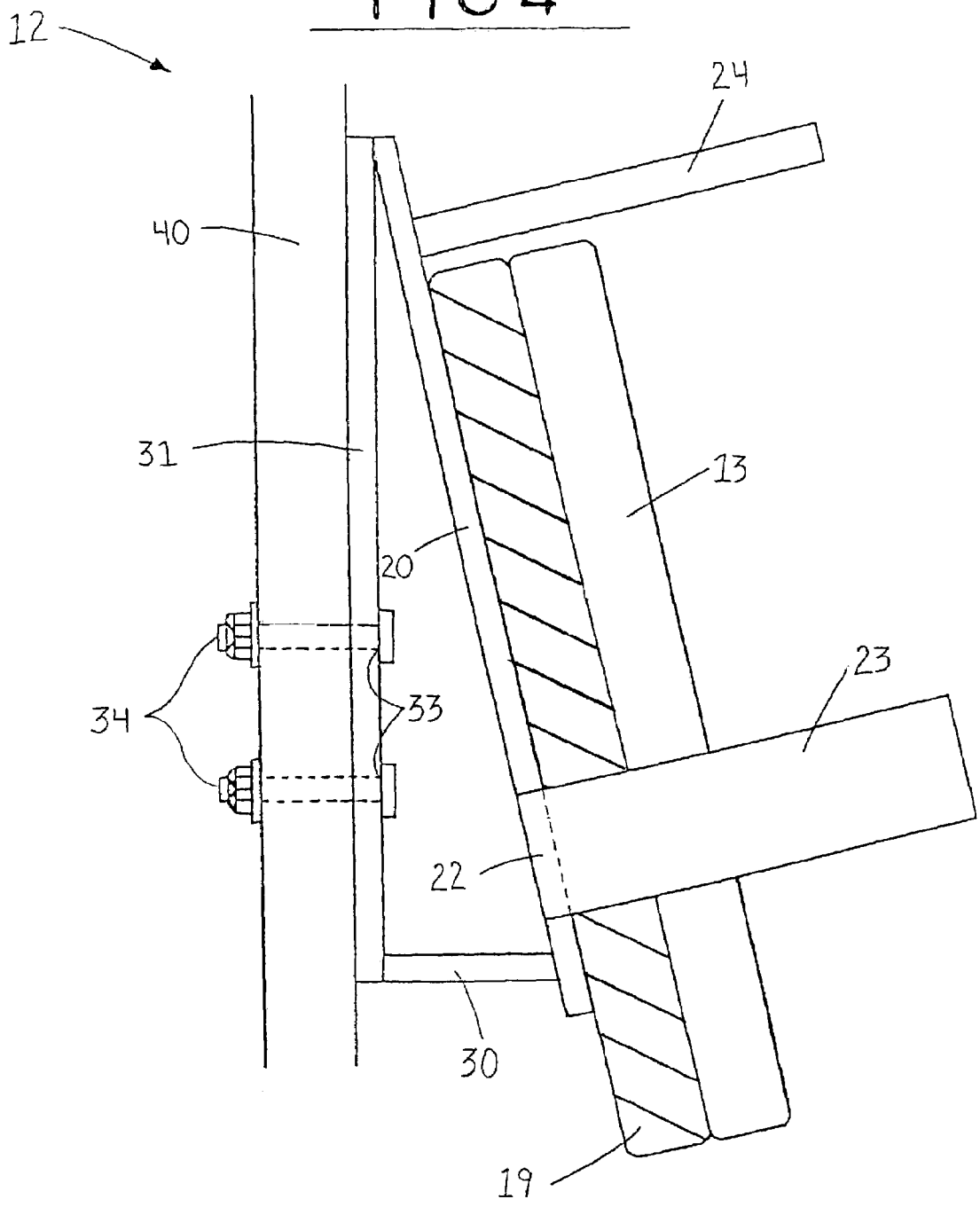
FIG. 4 is a side elevation view of the present invention embodied in an independent plate station, mounted to an existing exercise device.
Figure 5:
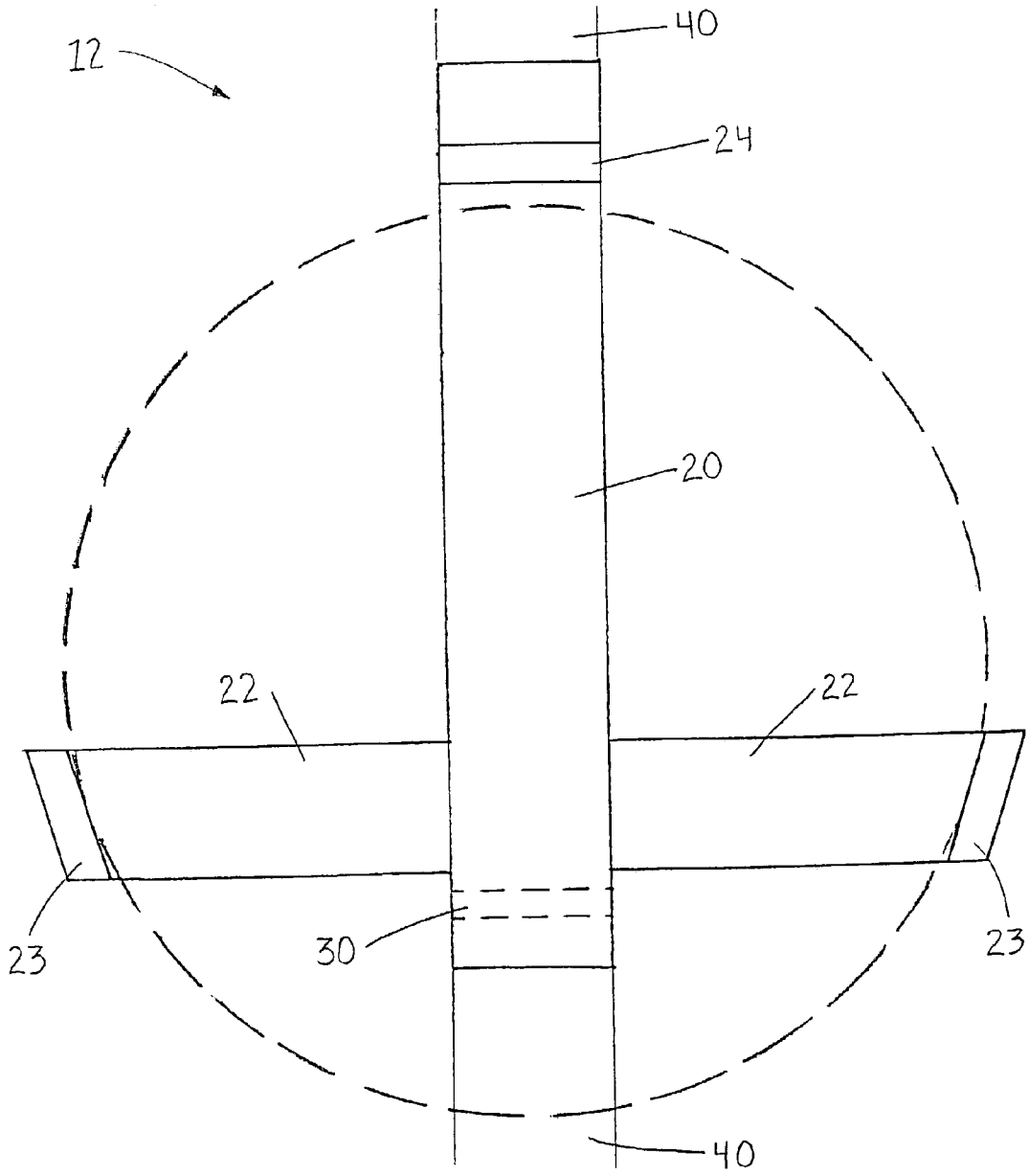
FIG. 5 is a front elevation of the present invention embodied in an independent plate station similar to the station shown in FIG. 4.

Referring now to FIGS. 4 and 5, another illustrative embodiment of a multi-member support storage implement in an independent station configuration is generally identified by the reference numeral 12. The independent station 12 shown is ideally fabricated from flat, steel bar that is present in many fitness equipment designs today. This type of metal will allow for a minimal amount of space to be occupied by the station, but maintain a strong cradle to support the plates. A foundation-mount bar 31 is adapted to mount flush to a vertical surface of an existing weight machine 40. A single or plurality of bolt-mounting holes 33 are located horizontally centered along the vertical axis of the foundation-mount bar 31 and are adapted to be large enough to allow mounting bolts 34 to pass through and connect the independent station to the weight machine 40. Protruding forward and perpendicular at the lower-most end of the foundation-mount bar 31 is a foundation-displacement bar 30. The foundation-displacement bar 30 extends horizontally and connects to the lower portion of the mainframe bar 20. The upper-most end of the mainframe bar 20 is connected to the upper-most end of the foundation-mount bar 31 to complete the base of the independent station. The foundation-displacement bar 30 is adapted to such a length to provide a sufficient backward angle of the independent station to prevent the plates from falling forwardly from the plate station.

In further reference to FIGS. 4 and 5, projecting laterally from both sides of the mainframe bar 20 are horizontal-extender bars 22. The horizontal-extender bars 22 would be constructed of the same flat, steel bar as the foundation-mount bar 31, the foundation displacement bar 30 and the mainframe bar 20. The length of the horizontal-extender bars 22 will vary depending on the diameter of the particular weight plate meant to be placed within the station. Mounted forwardly and perpendicular from the outer-most end of each horizontal-extender bar 22 is a plate-support bar 23. The plate-support bars 23 are greater than 2 inches in width so as to not allow the universal center openings of any weight plate to be placed upon them and would be preferably fabricated out of a non-marking metal such as chrome or stainless steel. The plate-support bars 23 are oriented to allow maximum surface contact with the plates and will ideally protrude 8 inches forward from the horizontal-extender bars 22, hereby allowing for an adequate number of plates to be stored within the station. The distance between the two plate-support bars 23 varies for each plate station and would be the same as described earlier in this document for the tree configuration.

Still referring to FIGS. 4 and 5, mounted directly to the mainframe bar 20, and superior to the plate-support bars 22, is a forwardly protruding height-limiting bar 24. The height-limiting bar 24 would be of the same size and structure as the plate-support bars 23 to prevent plates from being placed around it and to accommodate a sufficient number of plates within the station. The distance between the height-limiting bar 24 and the corresponding plate-support bars 23 for each station will vary according to the size of plate to be stored within the station and match the dimensions previously outlined in this document for the tree configuration.

Located within the plate station, mounted directly to the mainframe bar 20, superior to the plate support bars 23 and inferior to the height-limiting bar 24 is a false plate 19. This false plate 19 would ideally be constructed out of a soft, durable, non-marking material such as rubber, and have the same dimension of the standard weight plate to be placed within the station. The false plate 19 would have large markings on the planar surface indicating the size of the plate to be placed in the station. This false plate 19 would serve to render the plate location obvious when the plate station is empty and to protect the mainframe bar 20 and horizontal-extender bars 22 from being scratched when contacted by the plates.

The foregoing is considered as illustrative only of the principles of the invention. Further, since numerous modifications will readily occur to those skilled in the art, it is not intended to limit the invention to the exact construction and operation shown and described. Therefore, it is believed that the multi-member support implement may be configured and utilized in many plate storage designs as a substitute for conventional storage devices. More specifically, it is possible that the present invention be implemented into more than just weight trees or independent stations attached to exercise machines. In this regard, it is intended that all reasonably suitable additions, modifications, deletions and alterations be included within the scope of the invention as defined in the following claims.

What is claimed is:

1. A rack for storing weight lifting plates of various diameters and outer perimeters, having plural stations for storing the plates, each station comprising:

a plurality of plate-support members adapted to extend below, and contact the plates along the outer perimeter; and at least one height-limiting member adapted to extend above the plates along the outer perimeter;

wherein at least two plate-support members and one height-limiting member project outwardly from said rack and are disposed a predetermined distance apart from each other, said distance varies from one station to another and corresponds to one size plate diameter.

2. The rack of claim 1 wherein each station has at least two substantially parallel and horizontal plate-support members projecting outwardly from said rack and adapted to extend and contact the plates from below and along the outer perimeter, allowing the plates to come to rest on top of both plate-support members simultaneously.

3. The rack of claim 2 wherein at least two substantially parallel and horizontal plate-support members project outwardly from the rack and are disposed a specific fractional distance of one plate diameter from each other, creating a span of support for only one diameter weight lifting plate at each station.

4. The rack of claim 3 wherein said span of support between said plate-support members is a specific fractional distance of one plate diameter for each station, and varies from station to station.

5. The rack of claim 1 wherein each station has at least one substantially horizontal height-limiting member projecting outwardly from said rack and adapted to extend a short distance above the outer perimeter of the plates.

6. The rack of claim 5 wherein said horizontal height-limiting member projects outwardly from said rack, and is disposed a specific fractional distance of one plate diameter above and parallel to said plate-support members for each station.

7. The rack of claim 1 wherein at each station, the plate-support members and height-limiting member are disposed and separated from each other by a specific fractional distance of one plate diameter and the distance varies from station to station.

* * * * *